US011998064B2

(12) United States Patent
An et al.

(10) Patent No.: US 11,998,064 B2
(45) Date of Patent: Jun. 4, 2024

(54) POWERED CLEANING KIT FOR AN AEROSOL GENERATING DEVICE

(71) Applicant: KT&G CORPORATION, Daejeon (KR)

(72) Inventors: Hwi Kyeong An, Seoul (KR); Jong Myung Kim, Gyeonggi-do (KR); Seok Sun Yoon, Gyeonggi-do (KR); Jong Ik Lee, Gyeonggi-do (KR); Seung Peel Yim, Seoul (KR)

(73) Assignee: KT&G CORPORATION, Daejeon (KR)

( * ) Notice: Subject to any disclaimer, the term of this patent is extended or adjusted under 35 U.S.C. 154(b) by 540 days.

(21) Appl. No.: 17/285,585

(22) PCT Filed: Dec. 4, 2020

(86) PCT No.: PCT/KR2020/017628
§ 371 (c)(1),
(2) Date: Apr. 15, 2021

(87) PCT Pub. No.: WO2021/182721
PCT Pub. Date: Sep. 16, 2021

(65) Prior Publication Data

US 2022/0395029 A1 Dec. 15, 2022

(30) Foreign Application Priority Data

Mar. 11, 2020 (KR) ..... 10-2020-0030385

(51) Int. Cl.
*A24F 40/85* (2020.01)
*A24F 40/40* (2020.01)

(52) U.S. Cl.
CPC ..... *A24F 40/85* (2020.01); *A24F 40/40* (2020.01)

(58) Field of Classification Search
CPC ..... A24F 40/40; A24F 40/85; A46B 13/02–2200/3013; B08B 1/002; B08B 1/04
See application file for complete search history.

(56) References Cited

U.S. PATENT DOCUMENTS 5,040,553 A * 8/1991 Londono ..... A46B 17/04 401/184
8,689,804 B2 * 4/2014 Fernando ..... G06V 30/2253 131/184.1

(Continued)

FOREIGN PATENT DOCUMENTS

CN 208245246 U 12/2018
CN 109619692 A 4/2019

(Continued)

OTHER PUBLICATIONS

Extended European Search Report dated Oct. 28, 2021 in European Application No. 20875664.3.

(Continued)

*Primary Examiner* — Vanessa Girardi
(74) *Attorney, Agent, or Firm* — Sughrue Mion, PLLC

(57) ABSTRACT

A cleaning kit for an aerosol generating device includes a power supplier; a cleaner configured to clean the aerosol generating device by moving while contacting at least one of an accommodation unit and a heater of the aerosol generating device, and a driver configured to operate the cleaner according to power from the power supplier, and including a gear unit for changing an operating torque of the cleaner.

11 Claims, 7 Drawing Sheets

(56) References Cited

U.S. PATENT DOCUMENTS

| | | | | |
|---|---|---|---|---|
| 11,432,593 | B2 * | 9/2022 | Lee | A24F 40/40 |
| 2020/0359681 | A1 | 11/2020 | Han et al. | |
| 2021/0000186 | A1 | 1/2021 | Dayioglu | |
| 2021/0076748 | A1 * | 3/2021 | Chen | B08B 1/00 |
| 2021/0244105 | A1 | 8/2021 | Reevell | |

FOREIGN PATENT DOCUMENTS

| | | | |
|---|---|---|---|
| DE | 24 08 875 | A1 | 9/1975 |
| EP | 3 610 744 | A1 | 2/2020 |
| JP | 2019-208445 | A | 12/2019 |
| KR | 10-2018-0070441 | A | 6/2018 |
| KR | 10-1880984 | B1 | 7/2018 |
| KR | 10-1958875 | B1 | 3/2019 |
| KR | 20-0490513 | Y1 | 11/2019 |
| WO | 2019/175099 | A1 | 9/2019 |
| WO | 2019/192371 | A1 | 10/2019 |
| WO | 2020/016274 | A1 | 1/2020 |
| WO | 2020/016281 | A1 | 1/2020 |
| WO | 2020/032349 | A1 | 2/2020 |

OTHER PUBLICATIONS

Chinese Office Action dated Apr. 19, 2023 in Application No. 202080007451.1.

International Search Report for PCT/KR2020/017628 dated Mar. 22, 2021 [PCT/ISA/210].

Written Opinion for PCT/KR2020/017628 dated Mar. 22, 2021 [PCT/ISA/237].

* cited by examiner

POWERED CLEANING KIT FOR AN AEROSOL GENERATING DEVICE

CROSS REFERENCE TO RELATED APPLICATIONS

This application is a National Stage of International Application No. PCT/KR2020/017628 filed Dec. 4, 2020, claiming priority based on Korean Patent Application No. 10-2020-0030385 filed Mach 11, 2020.

TECHNICAL FIELD

Embodiments relate to a cleaning kit for an aerosol generating device, and more particularly, to a cleaning kit for an aerosol generating device that cleans an aerosol generating device by moving while contacting an accommodation unit and a heater of the aerosol generating device.

BACKGROUND ART

Recently, the demand for alternatives to the traditional cigarettes has increased. For example, there is growing demand for an aerosol generating device that generates aerosols by heating an aerosol generating material, rather than by combusting cigarettes. Accordingly, studies on a heating-type cigarette and a heating-type aerosol-generating device have been actively conducted.

When generating an aerosol by heating a cigarette, residue from the aerosol may adhere to an aerosol generating device. The adhered residue may be fixed and cause damage or a failure of the aerosol generating device. In addition, when a user uses an aerosol generating device, thermal efficiency may be reduced, and an unpleasant odor may occur during smoking due to incomplete combustion caused by heating of the adhered residue.

Accordingly, there is a need for users to individually clean the aerosol generating device. However, it is difficult for a user to completely remove the residue attached to the aerosol generating device by using a general cleaning tool.

DISCLOSURE OF INVENTION

Technical Problem

Residual materials attached to an aerosol generating device may cause damage or a failure of the aerosol generating device, and may cause discomfort to a user by changing flavor of a generated aerosol.

Accordingly, it is necessary to provide a cleaning kit to a user for efficiently removing residual materials attached to an aerosol generating device. To this end, the cleaning kit requires a certain amount of operating torque or more to remove the attached residual materials from elements (for example, a heater) of the aerosol generating device.

Technical problems to be solved by the present embodiments are not limited to the technical problems described above, and other technical problems may be inferred from the following embodiments.

Solution to Problem

Embodiments provide a cleaning kit for an aerosol generating device that cleans the aerosol generating device by moving while contacting an accommodation unit and a heater.

A cleaning kit for an aerosol generating device includes a power supplier; a cleaner configured to clean the aerosol generating device by moving while contacting at least one of an accommodation unit and a heater of the aerosol generating device, and a driver configured to operate the cleaner according to power from the power supplier, and including a gear unit for changing an operating torque of the cleaner.

Advantageous Effects of Invention

A cleaning kit for an aerosol generating device according to embodiments may clean the aerosol generating device by moving while contacting at least one of an accommodation unit and a heater of the aerosol generating device. A cleaner of the cleaning kit for an aerosol generating device may have various ranges of operating torque, and the operating torque may be of a predetermined range or more. As the operating torque of the predetermined range or more is transmitted to the cleaner, the cleaner may apply great external force to the accommodation unit and the heater of the aerosol generating device.

Accordingly, the cleaner may more efficiently remove residual materials attached to the heater and the accommodation unit, and a user may conveniently clean the aerosol generating device without using an additional cleaning tool or disassembling the aerosol generating device.

As residual materials of an aerosol generating device are removed, risk of damage or a failure of the aerosol generating device may be reduced. In addition, as residual materials are removed, unnecessary materials may be prevented from being generated when an aerosol generating device is heated, and thus, an aerosol having a high quality flavor may be provided to a user, thereby increasing satisfaction of the user.

BEST MODE FOR CARRYING OUT THE INVENTION

Figure 1:
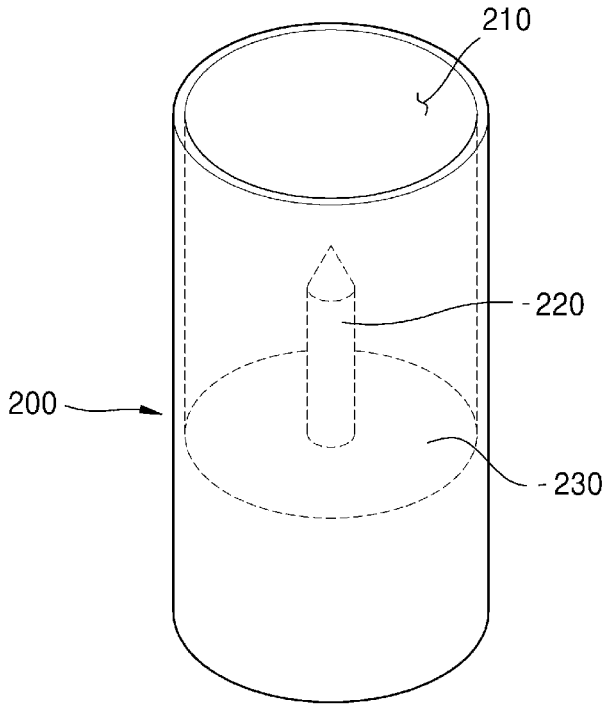
FIG. 1 illustrates an example of an aerosol generating device.

A cleaning kit for an aerosol generating device includes a power supplier; a cleaner configured to clean the aerosol generating device by moving while contacting at least one of an accommodation unit and a heater of the aerosol generating device, and a driver configured to operate the cleaner according to power from the power supplier, and including a gear unit for changing an operating torque of the cleaner.

The power supplier may be a battery, and the cleaning kit may further include an interface for charging the battery.

The power supplier may supply power through a wired connection with an external device.

The cleaning kit for an aerosol generating device may further include a cover portion that covers the cleaner.

The cleaner may be detachably coupled to the driver, and may include a cavity into which the heater is inserted when the cleaner is inserted into the accommodation unit of the aerosol generating device.

The cleaner may include a brush arranged to surround at least a part of the cavity.

The cleaner may include a protrusion, and the driver may include a groove for accommodating the protrusion.

The cleaning kit may further include a coupling structure for coupling the cleaner with the driver.

The coupling structure may couple the cleaner with the driver by magnetic force.

The cleaning kit for an aerosol generating device may further include a controller that changes the operating torque of the cleaner by controlling at least one of the power supplier and the driver.

The cleaning kit for an aerosol generating device may further include a switch electrically connected to the controller, and the controller may change the operating torque of the cleaner based on an operation of the switch.

The gear unit may include a first gear box and a second gear box, and the first gear box and the second gear box may be controlled independently of each other by the controller.

MODE FOR THE INVENTION

With respect to the terms in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

In addition, terms used in the present specification are for describing the embodiments and are not intended to limit the embodiments. In the present specification, the singular form also includes the plurality form unless specifically stated in the phrase.

Throughout the specification, the "longitudinal direction" of a component may be a direction in which the component extends along an axis in one direction of the component, wherein the axis in one direction of the component extends longer than an axis in the other direction of the component crossing the axis in one direction of the component.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Since various embodiments described in the specification are classified arbitrarily only for the purpose of explaining inventions, the embodiments should not be construed to be exclusive to each other. For example, some features disclosed in one embodiments may be applied to or implemented in other embodiments. Also, it is possible to change some features for applying or implement those features in other embodiments within scope and spirit of this disclosure.

Hereinafter, the present disclosure will now be described more fully with reference to the accompanying drawings, in which embodiments of the present disclosure are illustrated such that one of ordinary skill in the art may easily work the present disclosure. The disclosure may, however, be embodied in many different forms and should not be construed as being limited to the embodiments set forth herein.

FIG. 1 illustrates an example of an aerosol generating device 200.

Figure 2A:
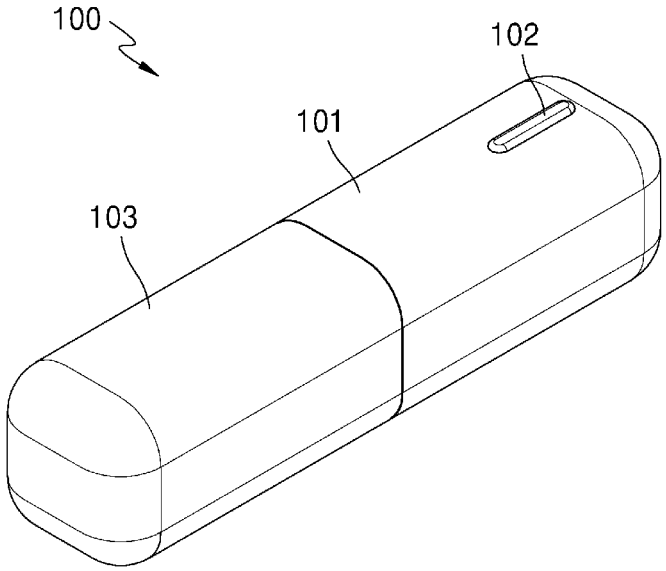
FIG. 2A is a perspective view of a cleaning kit for an aerosol generating device according to an embodiment.

FIG. 1 illustrates an example of the aerosol generating device 200 that is a subject of cleaning using a cleaning kit for an aerosol generating device according to an embodiment, which is shown in FIG. 2A. The aerosol generating device 200 may include an accommodation unit 210 and a heater 220.

The accommodation unit 210 of the aerosol generating device 200 may accommodate a cigarette. The cigarette may be accommodated in the accommodation unit 210 of the aerosol generating device 200 to be used and then removed by a user. When the cigarette is heated or removed, residual materials of the cigarette may be attached to the accommodation unit 210 of the aerosol generating device 200, a bottom portion 230 of the accommodation unit 210, and the heater 220. The residual materials generated from the cigarette may cause damage or a failure of the aerosol generating device 200, and when the residual materials are heated, a flavor of an aerosol may be deteriorated.

The aerosol generating device 200 may include the heater 220. The heater 220 of the aerosol generating device 200 may be, for example, an electro-resistive heater 220. The heater 220 includes an electrically conductive track, and the heater 220 may be heated as an electrical current flows through the electrically conductive track. The heater 220 in the aerosol generating device 200 of FIG. 1 is illustrated as a rod needle shape, but the shape of the heater 220 is not limited thereto. For example, the heater 220 may be of an external heating type and have a shape that surrounds a cigarette.

In the aerosol generating device 200 illustrated in FIG. 1, only some elements related to the cleaning kit 100 are illustrated. Therefore, it can be understood by those skilled in the art related to the embodiments that additional elements other than the elements illustrated in FIG. 1 may be further included in the aerosol generating device 200.

The configuration of the aerosol generating device 200 illustrated in FIG. 1 may be provided in more detail below to describe the cleaning kit for an aerosol generating device according to the embodiment, and will be compared and described together in the following drawings.

Figure 2B:
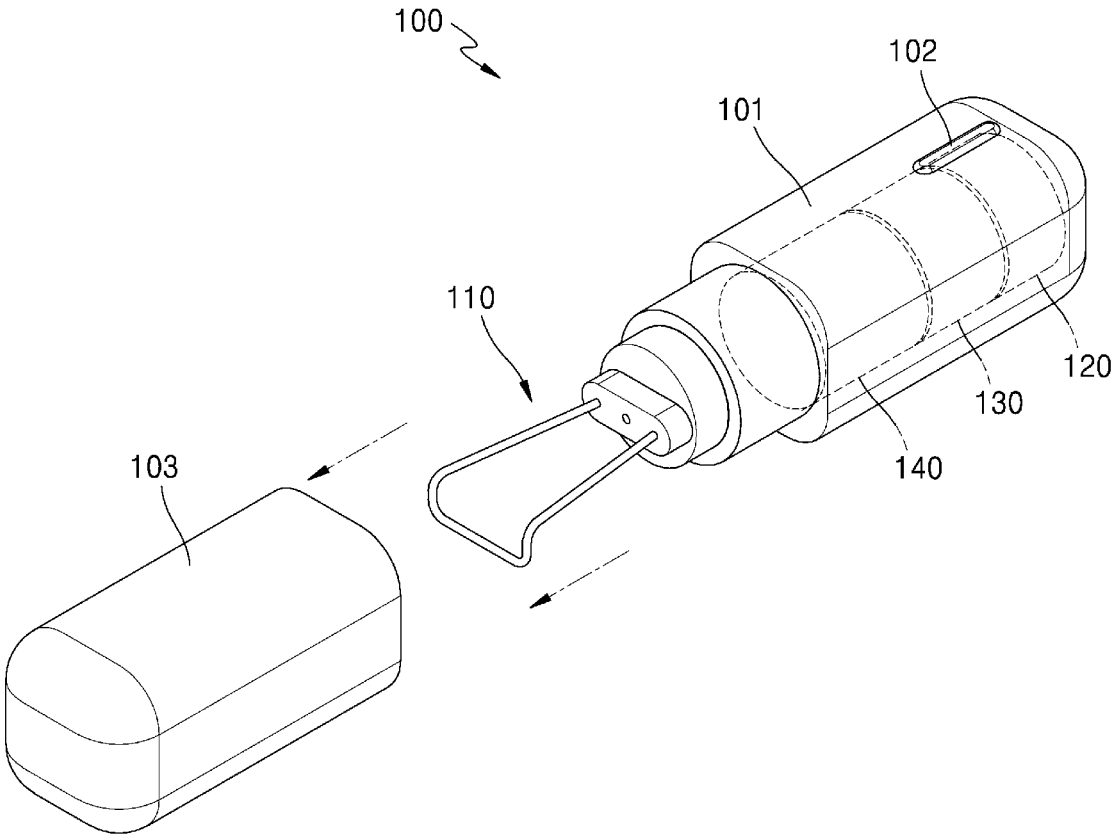
FIG. 2B is a perspective view of the cleaning kit for an aerosol generating device illustrated in FIG. 2A.

FIG. 2A is a perspective view of the cleaning kit 100 for an aerosol generating device according to an embodiment, and FIG. 2B is a perspective view of the cleaning kit 100 for an aerosol generating device illustrated in FIG. 2A.

The cleaning kit 100 for an aerosol generating device according to the embodiment may include a power supplier 120, a driver 140 that receives power from the power supplier 120, and a cleaner 110 that is operated by the driver 140 to clean the aerosol generating device 200.

The cleaning kit 100 may further include a cover portion 103 that covers the cleaner 110. When the cleaning kit 100 is not used, the cover portion 103 may serve to protect the cleaner 110 and form an exterior of the cleaning kit 100 together with a housing 101.

The cover portion 103 may be coupled to the cleaning kit 100 by, for example, interference fit or by magnetic force. In a case where the cover portion 103 is coupled to the cleaning kit 100 by interference fit, a hook portion (not illustrated) may be formed in the cover portion 103, and an accommodation groove (not illustrated) for accommodating the hook portion may be formed in the housing 101 of the cleaning kit 100. The hook portion formed in the cover portion 103 may be inserted into the accommodation groove to enable the cover portion 103 and the housing 101 to be closely coupled to each other.

A hollow may be formed inside the cover portion 103 to accommodate the cleaner 110. When the cleaning kit 100 is used, at least a part of the cover portion 103 may be separated from the housing 101 of the cleaning kit 100. That is, the cleaning kit 100 may be used by a user in a state in which a part of the cover portion 103 is connected to the housing 101 of the cleaning kit 100 or in a state in which the cover portion 103 is completely separated from the housing 101 of the cleaning kit 100.

A switch 102 may be arranged in the housing 101 of the cleaning kit 100 for an aerosol generating device. A user may operate the cleaning kit 100 through the switch 102. In addition, a controller may change an operating torque of the cleaner 110 based on a signal generated from the switch 102 when a user operates the switch 102.

The switch 102 may be formed on a surface of the housing 101 of the cleaning kit 100. The switch 102 may be implemented in the form of a user-friendly interface such as a plurality of buttons, and a shape, a size, and a position of the switch 102 may be changed as necessary.

The cleaning kit 100 for an aerosol generating device may include the power supplier 120. The power supplier 120 may supply power for the driver 140 to operate. As an example, the power supplier 120 may be a battery. The battery may be a lithium ion battery and may be charged by an external power source. When the power supplier 120 is a battery, the cleaning kit 100 for an aerosol generating device may include an interface (not illustrated; for example, a USB port, and so on) for charging the battery.

In this case, the interface for charging the battery may be arranged in the housing 101 of the cleaning kit 100, and a user may charge the battery by connecting an external power source to the battery through the interface.

As another example, the power supplier 120 may supply power through a wired connection with an external power source. That is, the power supplier 120 may not store but may have a configuration for direct connection with an external power source. In this case, the power supplier 120 may be a wire connecting the cleaning kit 100 to the external power source and may extend from the cleaning kit 100 toward outside.

The cleaning kit 100 for an aerosol generating device includes the driver 140 that receives power from the power supplier 120. The driver 140 may be a motor and may be connected to the cleaner 110 to operate the cleaner 110. The driver 140 may operate the cleaner 110 by performing rotation, vibration, or translation, and more than one of the above-described operations may be performed simultaneously in combination.

The cleaner 110 may be connected to the driver 140. The cleaner 110 may receive power from the driver 140. The cleaner 110 and the driver 140 may be arranged in the cleaning kit 100 in series along a longitudinal direction of the cleaner 110.

The cleaner 110 may clean the aerosol generating device 200 by moving (e.g., rotating) while contacting the accommodation unit 210 and the heater 220 of the aerosol generating device 200. As the cleaner 110 moves (e.g., rotates) while contacting the accommodation unit 210 and the heater 220 of the aerosol generating device 200, residual materials attached to the heater 220 and the accommodation unit 210 may be separated by the cleaner 110.

Figure 3A:
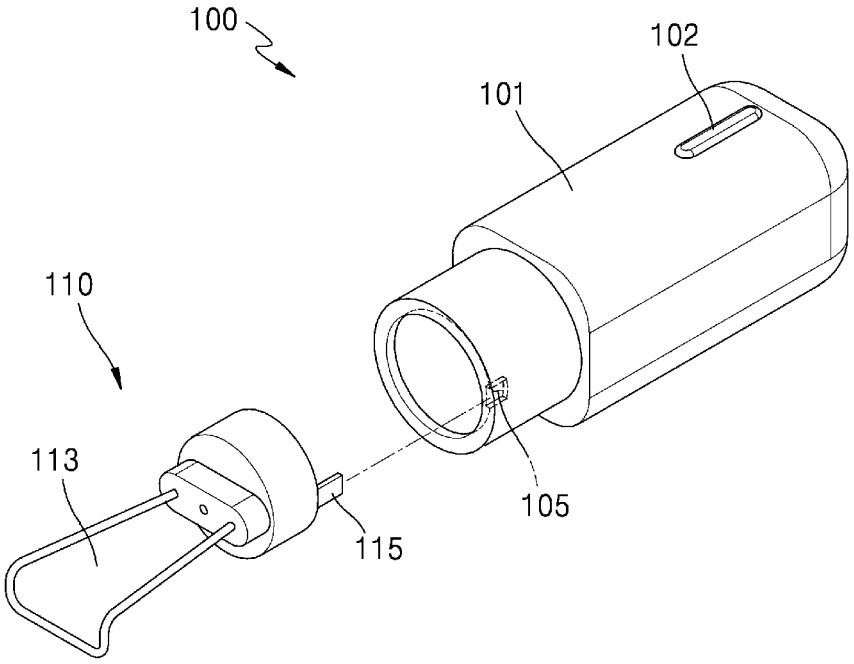
FIG. 3A is a perspective view schematically illustrating a coupling relationship of elements of the cleaning kit for an aerosol generating device illustrated in FIG. 2A.
Figure 3B:
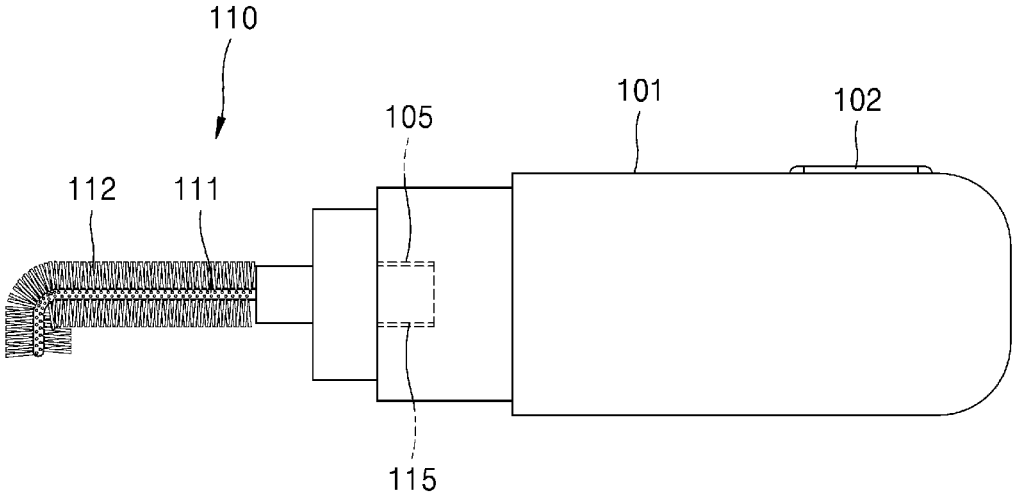
FIG. 3B is a side view of the cleaning kit for an aerosol generating device according to the embodiment illustrated in FIG. 3A.

FIG. 3A is a perspective view schematically illustrating a coupling structure of the cleaner 110 which is one element of the cleaning kit 100 illustrated in FIG. 2, and FIG. 3B is a side view of the cleaning kit 100 illustrated in FIG. 3A.

The cleaner 110 of the cleaning kit 100 for an aerosol generating device according to the embodiment described above may be detachably coupled to the driver 140. The cleaner 110 may be manufactured to be replaceable. As the cleaning kit 100 is repeatedly used over time, the cleaner 110 may be bent or worn. The cleaner 110 may be replaced to prevent a reduction in cleaning efficiency of the cleaner 110. As the cleaner 110 is detachably coupled to the driver 140, a user may easily remove the used cleaner 110 from the driver 140 and couple a new cleaner 110 to the driver 140 as needed.

The cleaner 110 may include a protrusion 115 protruding in a direction toward the driver 140, and the driver 140 may include a groove 105 for accommodating the protrusion 115. The protrusion 115 formed in the cleaner 110 may be formed at one end of the cleaner 110, and in this case, the one end may be facing the driver 140 when the cleaner 110 and the driver 140 are connected to each other.

When the cleaner 110 is rotated by the driver 140, the protrusion 115 may prevent the cleaner 110 from rotating separately with respect to the driver. That is, the protrusion 115 may cause the cleaner 110 to operate in synchronization with the driver 140 so that cleaning efficiency may be increased.

The protrusion 115 may have a prism shape, for example, a rectangular prism shape. The groove 105 may have a shape corresponding to the protrusion 115 and may be formed at a position corresponding to a position of the protrusion 115. For example, when the protrusion 115 has the rectangular prism shape, the groove 105 for accommodating the protrusion 115 may have a shape corresponding to the rectangular prism.

The cleaning kit 100 may include a coupling structure for coupling the cleaner 110 and the driver 140. The coupling structure may be arranged in at least a part of the cleaner 110 and at least a part of the driver 140.

As an example, the coupling structure may couple the cleaner 110 to the driver 140 with magnetic force. For example, the coupling structure may be included in the protrusion 115 of the cleaner 110 and the groove 105 of the driver 140. In this case, the protrusion 115 and the groove 105 may include magnets as the coupling structure and may be magnetically coupled to each other. When a user replaces the cleaner 110, the user may remove the cleaner 110 from the driver 140 by applying external force greater than attractive force between the protrusion 115 and the groove 105.

Thereafter, when the new cleaner 110 approaches the driver 140 by a user, the protrusion 115 and the groove 105 are extracted to each other by attractive force. Accordingly, the cleaner 110 and the driver 140 may be coupled to each other by the protrusion 115 and the groove 105.

The cleaner 110 may include a cavity 113 into which the heater 220 is inserted. Referring to FIG. 3B, the cleaner 110 may include a brush 112 arranged around the cavity 113. The brush 112 may include a body portion 111 and fine hairs attached to the body portion 111.

One end of the body portion 111 may be curved in a direction crossing a length direction of the cleaner 110. As one end of the body portion 111 is curved, one end of the body portion 111 may come into contact with a wide area of the bottom portion 230 of the accommodation unit 210 of the aerosol generating device 200. The fine hairs attached along one end of the curved body portion 111 may remove residual materials attached to the bottom portion 230 of the accommodation unit 210 of the aerosol generating device 200.

When the cleaning kit 100 is inserted into the accommodation unit 210 of the aerosol generating device 200, the heater 220 may be inserted into the cavity 113 formed in the cleaner 110. As the heater 220 is inserted into the cavity 113 of the cleaner 110, the brush 112 may surround the heater 220.

When the cleaning kit 100 operates, the cleaner 110 may rotate with the heater 220 being a rotational axis of the rotation of the cleaner 110, may translate with respect to the heater 220, or may vibrate with respect to the heater 220, thereby cleaning the heater 220. A method of operating the cleaner 110 is not limited by the above description, and the cleaner 110 may operate by at least one of rotation, translation, and vibration movements.

The cleaning kit 100 for an aerosol generating device may include a suction unit (not illustrated). The suction unit may collect residual materials separated by the cleaner 110 by sucking air together with the residual materials. For example, the suction unit may be arranged adjacent to the cleaner 110 to suck residual materials attached to or removed from the cleaner 110.

The cleaning kit 100 for an aerosol generating device may include a discharge unit (not illustrated) connected to the suction unit. The discharge unit may be in fluid communication with the suction unit to discharge residual materials collected by the suction unit.

Figure 4A:
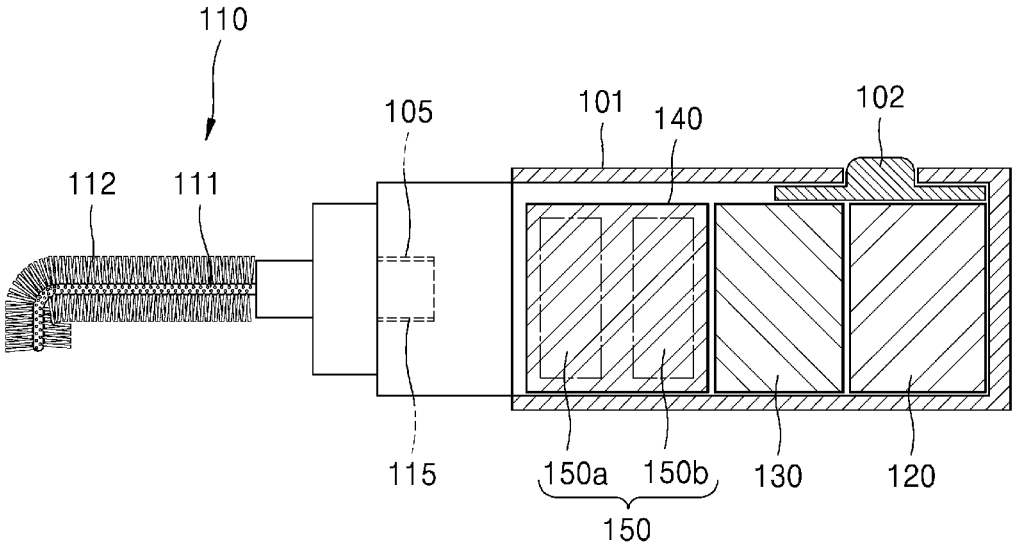
FIG. 4A is a cross-sectional view of the cleaning kit for an aerosol generating device according to the embodiment illustrated in FIG. 2A.
Figure 4B:
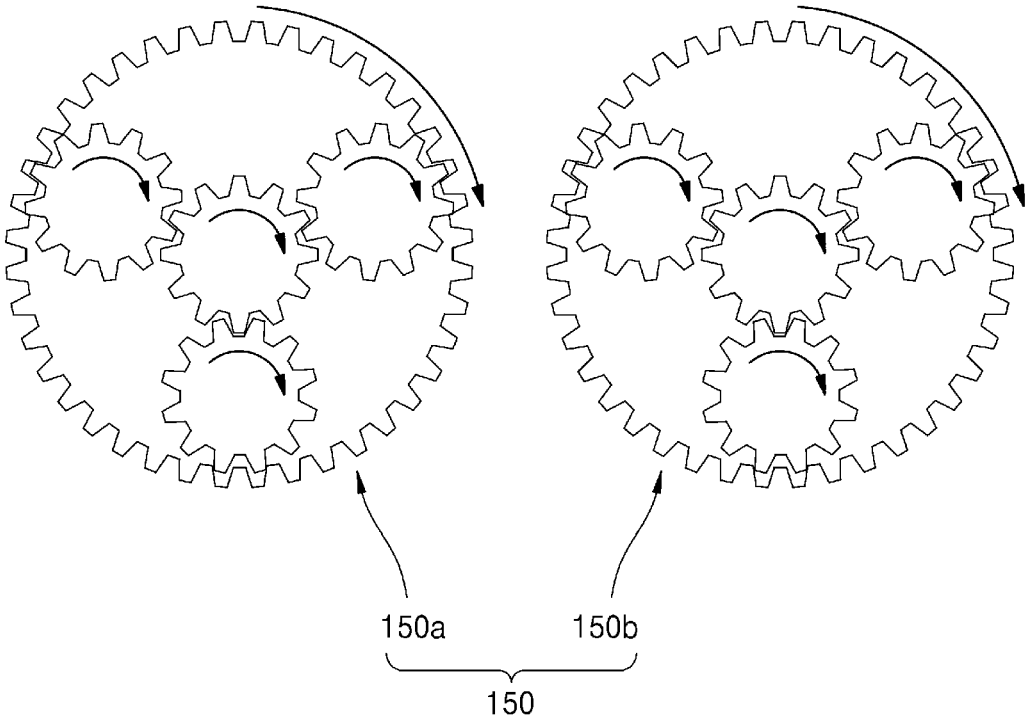
FIG. 4B is concept diagram explaining some elements of the cleaning kit for an aerosol generating device according to the embodiment illustrated in FIG. 4A.

FIG. 4A is a cross-sectional view of the cleaning kit 100 for an aerosol generating device according to the embodiment illustrated in FIG. 2A. FIG. 4B is concept diagram explaining some elements of the cleaning kit for an aerosol generating device according to the embodiment illustrated in FIG. 4A.

The cleaning kit 100 for an aerosol generating device according to the above-described embodiment may further include a controller 130 that changes an operating torque of the cleaner 110 by controlling the power supplier 120 and the driver 140.

The controller 130 may operate the cleaning kit 100 for an aerosol generating device by controlling the power supplier 120. The controller 130 may also control an operation of other elements included in the cleaning kit 100. In addition, the controller 130 may determine whether or not the cleaning kit 100 is in an operable state by checking status of the elements of the cleaning kit 100.

The controller 130 may include at least one processor. The processor may be implemented with an array of a plurality of logic gates or may also be implemented with a combination of a general-purpose microprocessor and a memory in which a program executable in the microprocessor is stored. In addition, it can be understood by those skilled in the art to which the present embodiment belongs that the process may be implemented with other types of hardware.

Although not illustrated, the cleaning kit 100 may include, for example, a display capable of outputting visual information. For example, by generating a signal to be displayed on the display, the controller 130 may provide a user with information related to the power supplier 120, information related to the replacement of the cleaner 110, and information related to an operating torque of the cleaner 110 driven by the driver 140.

In addition, the cleaning kit 100 may include, for example, a sound output device (for example, a speaker) capable of outputting auditory information. The controller 130 may transmit information on the cleaning kit 100 to a user through the sound output device. For example, when the cleaner 110 of the cleaning kit 100 does not operate, the cleaning kit 100 may generate a predetermined sound and provide the sound to a user.

In the cleaning kit 100 for an aerosol generating device according to the above-described embodiment, the switch 102 may be electrically connected to the controller 130. A user may transmit an electrical signal to the controller 130 through the switch 102, and the controller 130 receiving the electrical signal may control elements of the cleaning kit 100.

For example, a user may turn on/off the cleaning kit 100 through the switch 102. In addition, the user may also change an operating torque of the cleaner 110 through the switch 102.

The user may increase the operating torque of the cleaner 110 through the switch 102. As the operating torque of the cleaner 110 increases, the rotational speed of the cleaner 110 may be reduced when the cleaner 110 rotates, and pressure applied to the elements of the aerosol generating device 200 by the cleaner 110 may be increased.

The user may reduce the operating torque of the cleaner 110 through the switch 102. As the operating torque of the cleaner 110 is reduced, the rotational speed of the cleaner 110 may be increased when the cleaner 110 rotates, and the pressure applied to the configuration elements of the aerosol generating device 200 by the cleaner 110 may be reduced.

A gear unit 150 of the driver 140 may include a first gear box 150*a* and a second gear box 150*b*. The first gear box 150*a* and the second gear box 150*b* may be controlled of each other by the controller 130. For example, as one example of various operation modes, the controller 130 may drive the first gear box 150*a* of the gear unit 150 and may not drive the second gear box 150*b*. The gear unit 150 is not limited to the first gear box 150*a* and the second gear box 150*b* and may include three or more gear boxes.

As the gear unit 150 includes a plurality of gear boxes, and the plurality of gear boxes are independently controlled, the cleaner 110 may have various ranges of operating torque. For example, as the first gear box 150*a* and the second gear box 150*b* are controlled independently of each other, the cleaner 110 may have different operating torques according to a plurality of combinations of operations of the first gear box 150*a* and the second gear box 150*b*.

For example, when only the first gear box 150*a* is controlled to operate, when only the second gear box 150*b* is controlled to operate, and when both the first and second gear boxes 150*a* and 150*b* are controlled to operate, the cleaner 110 may have different operating torques. As the gear unit 150 includes a plurality of gear boxes, the number of combinations may be increased.

The cleaning kit 100 for an aerosol generating device according to the embodiments may clean the aerosol generating device 200 by moving while contacting the accommodation unit 210 and/or the heater 220 of the aerosol generating device 200. The cleaner 110 of the cleaning kit 100 of the aerosol generating device may have various ranges of operating torque, and the operating torque may be in a predetermined range or more. As an operating torque of a predetermined range or more is transmitted to the cleaner 110, the cleaner 110 may apply greater force to the accommodation unit 210 and the heater 220 of the aerosol generating device 200.

Accordingly, the cleaner 110 may more efficiently remove residual materials attached to the heater 220 and the accommodation unit 210, and a user may conveniently clean the aerosol generating device 200 without using an additional cleaning tool or disassembling the aerosol generating device 200.

As residual materials of the aerosol generating device 200 are removed, risk of damage or a failure of the aerosol generating device 200 may be reduced. In addition, as residual materials are removed, unnecessary materials may be prevented from being generated when an aerosol generating device is heated, and thus, an aerosol having a high quality flavor may be provided to a user, thereby increasing satisfaction of the user.

At least one of the components, elements, modules or units (collectively "components" in this paragraph) represented by a block in the drawings, such as the controller 130, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

Those skilled in the technical field related to the present embodiments will appreciate that the present embodiments may be implemented in a modified form without departing from the essential characteristics of the above description. Therefore, the disclosed methods should be considered in a descriptive sense only and not for purposes of limitation. The scope of the present disclosure is illustrated in the claims rather than the foregoing description, and all differences within the scope equivalent thereto should be interpreted as being included in the present disclosure.

The invention claimed is:

1. A cleaning kit for an aerosol generating device, comprising:

a power supplier;

a cleaner configured to clean the aerosol generating device by moving while contacting at least one of an accommodation unit and a heater of the aerosol generating device;

a driver configured to operate the cleaner according to power from the power supplier, and including a gear unit for changing an operating torque of the cleaner; and a controller configured to change the operating torque of the cleaner by controlling at least one of the power supplier and the driver, wherein the gear unit comprises a first gear box and a second gear box, and wherein the first gear box and the second gear box are configured to be controlled independently of each other by the controller.

2. The cleaning kit for an aerosol generating device of claim 1, wherein the power supplier is a battery, and wherein the cleaning kit further comprises an interface for charging the battery.

3. The cleaning kit for an aerosol generating device of claim 1, wherein the power supplier supplies power through a wired connection with an external device.

4. The cleaning kit for an aerosol generating device of claim 1, further comprising a cover portion that covers the cleaner.

5. The cleaning kit for an aerosol generating device of claim 1, further comprising a switch electrically connected to the controller, wherein the controller is configured to change the operating torque of the cleaner based on an operation of the switch.

6. The cleaning kit of claim 1, wherein the controller is configured to:

cause the cleaner to move with a first operating torque by controlling the first gear box and the second gear box to operate;

cause the cleaner to move with a second operating torque by controlling the first gear box to operate without the second gear box operating; and cause the cleaner to move with a third operating torque by controlling the second gear box to operate without the first gear box operating, wherein the first operating torque, the second operating torque, and the third operating torque are different from each other.

7. The cleaning kit for an aerosol generating device of claim 1, wherein the cleaner is detachably coupled to the driver, and comprises a cavity into which the heater is inserted when the cleaner is inserted into the accommodation unit of the aerosol generating device.

8. The cleaning kit for an aerosol generating device of claim 7, wherein the cleaner comprises a brush arranged to surround at least a part of the cavity.

9. The cleaning kit for an aerosol generating device of claim 7, wherein the cleaner comprises a protrusion, and wherein the driver comprises a groove for accommodating the protrusion.

10. The cleaning kit for an aerosol generating device of claim 7, further comprising a coupling structure configured to couple the cleaner with the driver.

11. The cleaning kit for an aerosol generating device of claim 10, wherein the coupling structure is configured to couple the cleaner with the driver by magnetic force.

* * * * *